US012672679B2

(12) United States Patent
Lakraa

(10) Patent No.: US 12,672,679 B2
(45) Date of Patent: Jul. 7, 2026

(54) METHOD OF OPERATING AN AEROSOL-GENERATING DEVICE

(71) Applicant: JT International SA, Geneva (CH)

(72) Inventor: Karima Lakraa, Lausanne (CH)

(73) Assignee: JT International SA, Geneva (CH)

( * ) Notice: Subject to any disclaimer, the term of this patent is extended or adjusted under 35 U.S.C. 154(b) by 318 days.

(21) Appl. No.: 17/918,800

(22) PCT Filed: Apr. 20, 2021

(86) PCT No.: PCT/EP2021/060230
§ 371 (c)(1),
(2) Date: Oct. 13, 2022

(87) PCT Pub. No.: WO2021/214051
PCT Pub. Date: Oct. 28, 2021

(65) Prior Publication Data

US 2023/0144873 A1 May 11, 2023

(30) Foreign Application Priority Data

Apr. 23, 2020 (EP) ..... 20171186
Apr. 23, 2020 (EP) ..... 20171187

(51) Int. Cl.
*A24F 40/53* (2020.01)
*A24F 40/485* (2020.01)
(Continued)

(52) U.S. Cl.
CPC ..... *A24F 40/53* (2020.01)

(58) Field of Classification Search
None
See application file for complete search history.

(56) References Cited

U.S. PATENT DOCUMENTS

2007/0036348 A1 2/2007 Orr
2011/0094523 A1* 4/2011 Thorens ..... H05B 1/0202 131/194
(Continued)

FOREIGN PATENT DOCUMENTS

CA 2845090 A1 2/2013
CA 3083718 A1 5/2019
(Continued)

OTHER PUBLICATIONS

International Search Report for Application No. PCT/EP2021/060230 mailed Jul. 29, 2021, pp. 1-6.
(Continued)

*Primary Examiner* — Philip Y Louie
*Assistant Examiner* — Charlotte Davison
(74) *Attorney, Agent, or Firm* — Lerner David LLP

(57) ABSTRACT

A method of operating an aerosol-generating device includes detecting puffs taken by a user; monitoring a time elapsed after each puff; counting the puffs in succession unless a reset condition is satisfied; and restarting counting the puffs when the reset condition is satisfied. An aerosol-generating device includes a body having an inlet and an outlet with an air channel defined between the inlet and the outlet; a puff detector configured to detect puffs taken by a user; a timing unit configured to determine a time elapsed after each puff; and a controller configured to: start a first counter to count the puffs in succession unless a reset condition is satisfied; and reset the first counter when the reset condition is satisfied.

18 Claims, 8 Drawing Sheets

(51) Int. Cl.
*A24F 40/50* (2020.01)
*A24F 40/51* (2020.01)

(56) References Cited

U.S. PATENT DOCUMENTS

| | | | | |
|---|---|---|---|---|
| 2012/0048266 | A1 | 3/2012 | Alelov | |
| 2013/0042865 | A1 | 2/2013 | Monsees et al. | |
| 2014/0278258 | A1* | 9/2014 | Shafer | A24F 40/51 702/189 |
| 2015/0142387 | A1* | 5/2015 | Alarcon | A24F 40/65 702/187 |
| 2015/0230521 | A1 | 8/2015 | Talon | |
| 2015/0257445 | A1 | 9/2015 | Henry, Jr. et al. | |
| 2016/0206005 | A1 | 7/2016 | Yamada et al. | |
| 2016/0316821 | A1 | 11/2016 | Liu | |
| 2017/0262064 | A1 | 9/2017 | Ofir et al. | |
| 2017/0295844 | A1* | 10/2017 | Thevenaz | A24F 40/46 |
| 2018/0271155 | A1 | 9/2018 | Baker | |
| 2019/0142067 | A1 | 5/2019 | Martzel | |
| 2019/0380388 | A1 | 12/2019 | Amorde et al. | |
| 2020/0154786 | A1* | 5/2020 | Novak, III | A24F 40/90 |
| 2020/0305511 | A1 | 10/2020 | Wilson et al. | |
| 2020/0352249 | A1* | 11/2020 | Achtien | A61M 15/0066 |
| 2022/0248503 | A1 | 8/2022 | Mironov et al. | |

FOREIGN PATENT DOCUMENTS

| | | | |
|---|---|---|---|
| CN | 103734915 | A | 4/2014 |
| CN | 105377064 | A | 3/2016 |
| CN | 106102811 | A | 11/2016 |
| CN | 106302970 | A | 1/2017 |
| CN | 106455716 | A | 2/2017 |
| CN | 107250947 | A | 10/2017 |
| CN | 108463128 | A | 8/2018 |
| CN | 109068751 | A | 12/2018 |
| CN | 110520003 | A | 11/2019 |
| CN | 110545682 | A | 12/2019 |
| EP | 3042576 | A1 | 7/2016 |
| EP | 3207811 | A1 | 8/2017 |
| EP | 3610742 | A2 | 2/2020 |
| EP | 3610747 | A2 | 2/2020 |
| JP | 2015503916 | A | 2/2015 |
| KR | 20160001476 | U | 5/2016 |
| WO | 2015046420 | A1 | 4/2015 |
| WO | 2015077646 | A1 | 5/2015 |
| WO | 2017137512 | A1 | 8/2017 |
| WO | 2017179043 | A1 | 10/2017 |
| WO | 2020021115 | A2 | 1/2020 |

OTHER PUBLICATIONS

International Search Report for Application No. PCT/EP2021/060231 mailed Jul. 22, 2021, pp. 1-3.
Search Report dated Jul. 22, 2025 from Office Action for Chinese Application No. 202180030262.0 issued Jul. 23, 2025. 2 pages.
Search Report dated Feb. 10, 2025 from Office Action for Chinese Application No. 202180030262.0 issued Feb. 21, 2025. 2 pages.
Search Report dated Feb. 17, 2025 from Office Action for Chinese Application No. 202180021054.4 issued Feb. 22, 2025. 3 pages.

* cited by examiner

METHOD OF OPERATING AN AEROSOL-GENERATING DEVICE

CROSS-REFERENCE TO RELATED APPLICATIONS

The present application is a national phase entry under 35 U.S.C. § 371 of International Application No. PCT/EP2021/060230, filed Apr. 20, 2021, published in English, which claims priority to European Application No. 20171186.8 filed Apr. 23, 2020 and to European Application No. 20171187.6 filed Apr. 23, 2020, the disclosures of which are incorporated herein by reference.

FIELD OF INVENTION

The present invention relates to a method of operating an aerosol generating device for enhanced user experience. More specifically, it relates to an aerosol generating device such as e-cigarettes, heat-not-burn devices, and the like which is capable of measuring aerosol intake based on usage pattern.

BACKGROUND

Inhalers or aerosol generating devices such as e-cigarettes or vaping devices are becoming increasingly popular. They generally heat or warm an aerosolisable substance to generate an aerosol for inhalation, as opposed to burning tobacco as in conventional tobacco products. The generated aerosol may contain a flavour and/or a stimulant (e.g., nicotine or other active component). Users of such inhalers may wish to monitor the amount of flavour or stimulant taken during use at times.

Most aerosol generating devices incorporate some form of electronic control circuit, typically including a simple computer processor, allowing a user to control operation of the aerosol generation device. However, these devices can be quite restrictive in their settings and may not offer much flexibility to the user. Even in devices that allow a user to customise settings, it requires some effort from the user and may not be intuitive.

Therefore, there exists a need for a device that can be operated and controlled in accordance with the user's preference for aerosol monitoring without requiring much effort.

SUMMARY OF THE INVENTION

According to an aspect of the present invention, there is provided a method of operating an aerosol-generating device comprising detecting puffs taken by a user; monitoring a time elapsed after each puff; counting the puffs in succession unless a reset condition is satisfied; and restarting counting the puffs when a reset condition is satisfied.

Advantageously, by controlling a vaping device in accordance with this method it is possible to safely monitor puffs taken by the user during a vaping session without needing the user intervention. If use of the vaping device satisfies a reset condition, subsequent puffs are counted in a new session.

Preferably, the method includes determining an orientation of the device wherein the reset condition is based on the orientation of the device. In this way, the user can adjust the device orientation as a convenient way to restart counting of the puffs.

The reset condition may be based on a length of time in which the device remains in a particular orientation. In this way, the device can account for temporary changes in orientation, such that if a user accidentally changes the orientation of the device, it will not restart the counting.

The reset condition may be based on a determination of whether the time elapsed is greater than a first preset value. In this way, if the user takes a long break between puffs, it is determined that the user is not engaging in sustained continuous vaping and thus puffs taken after such a long break are counted in a new session.

The reset condition may also be based on the number of puffs taken in a predetermined period of time. In this way, the frequency of puffs taken by a user can be used to determine whether puffs should be counted in the same session, or whether the counting should restart.

Preferably, the method includes providing a first indication to the user when a number of puffs reaches a first count.

Preferably, in the said method, the first indication is only provided when the puffs are counted while the device is being held in a first orientation.

Preferably, the method includes providing the first indication to the user when the number of puffs reaches the first count when the device is determined to be temporarily held in a second orientation, different from the first orientation, for less than a predetermined period of time and is turned to the first orientation within the predetermined period of time.

Preferably, the method includes providing a second indication to the user when the total number of puffs at the end of a predetermined period of use reaches a second count if the device is determined to be held in the first orientation at least once during the predetermined period of use.

Preferably, in the said method, the total number of puffs is determined by a time stamp associated with each puff.

Preferably, in the said method, the total number of puffs is determined by maintaining a count of puffs for a period set by the user.

Preferably, in the said method, the second indication is only provided when an amount of aerosol delivered in the total number of puffs exceeds a threshold level.

According to another aspect of the invention, there is provided a control circuitry for use in an aerosol-generating device, the control circuitry configured to actuate the method as described above.

According to another aspect of the invention, there is provided an aerosol-generating device comprising a body having an inlet and an outlet with an air channel defined between the inlet and the outlet; a puff detector configured to detect puffs taken by a user; a timing unit configured to determine a time elapsed after each puff; and a controller configured to start a first counter to count the puffs in succession unless a reset condition is satisfied; and reset the first counter when the reset condition is satisfied.

Method steps may be provided as corresponding apparatus features and vice-versa. Preferably, in the said device, the timing unit is configured to start a timer at an end of each puff and stop the timer when the puff detector detects a start of a next puff.

Preferably, the device further includes a second counter configured to count puffs taken by the user during a predetermined period of use.

Preferably, the device further includes a recognition sensor to identify an aerosol source to monitor an amount of aerosol in each puff taken by the user.

Preferably, in the said device, the timing unit is further configured to associate each puff session with a time stamp to monitor aerosol intake of the user over time.

According to yet another aspect of the invention, there is provided a computer-readable storage medium comprising instructions which, when executed by a computer, cause the computer to carry out the steps of the method as described above.

BRIEF DESCRIPTION OF THE DRAWINGS

Embodiments of the invention are now described, by way of example, with reference to the drawings, in which.

DETAILED DESCRIPTION

Next, various aspects of the invention will be described. Note that the same or similar portions are denoted with the same or similar reference signs in the descriptions of the drawings below. Note that the drawings are schematic and a ratio of each size is different from a real one. Therefore, specific sizes and the like should be judged in consideration of the following descriptions.

Figure 1:
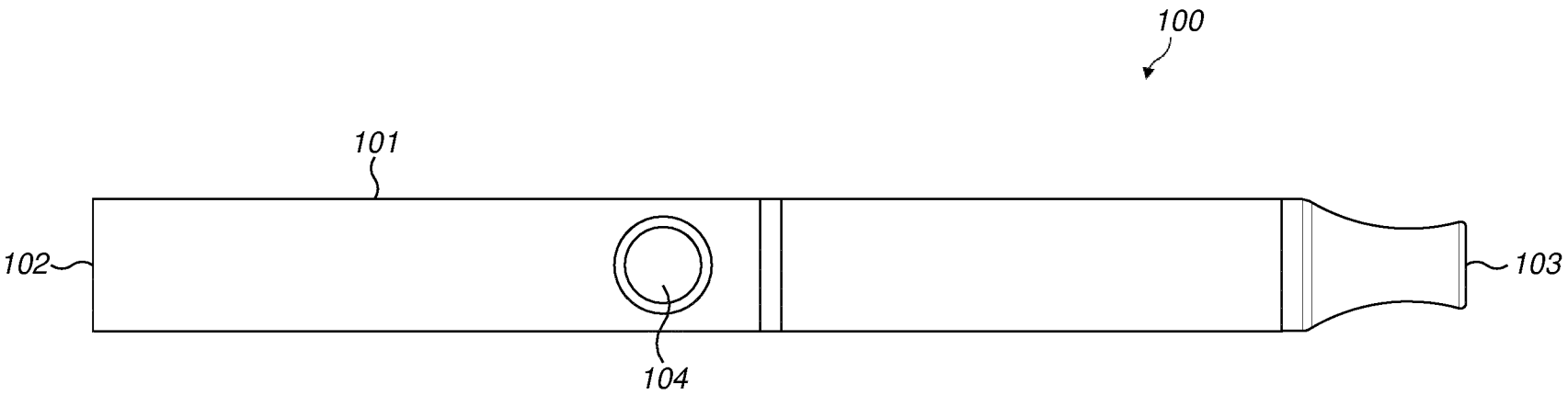
FIG. 1 shows an aerosol generating device according to an aspect of the invention.

FIG. 1 shows a non-combustion-type aerosol generating device 100, which is a device for inhaling an aerosol by heating or vaporisation without combustion. The device 100 has a rod-like shape with a main body 101 extending from a non-mouthpiece end 102 to a mouthpiece end 103. An air channel or path is defined in the main body 100 between the opposite ends 102, 103. The aerosol-generating device 100 in the present example is an electronic cigarette or a vaping device, and is referred to as e-cig 100 hereinafter. The e-cig 100 works by vaporizing or heating an aerosol source inserted into the e-cig 100 to release a flavour and/or a stimulant for a user to inhale through the mouthpiece end 103. The construction and operation of such a device to generate aerosol is well-known in the art and it will be understood by a skilled person that the invention disclosed herein can be applicable to aerosol generation devices in any shapes, configured with any aerosol generating techniques, not limited to the example.

The e-cig 100 may include an activation switch 104 that may be configured to perform at least one of a turn-on and a turn-off of a power source of the e-cig 100. The activation switch 104 may be a push button or a touch button disposed at any convenient location on the surface of the main body 101 of the e-cig 100. Alternatively, the e-cig 100 does not rely on a switch button to activate power supply to heater, but rely on a puff sensor to detect air flow and trigger the device to start generating aerosol.

Figure 2:
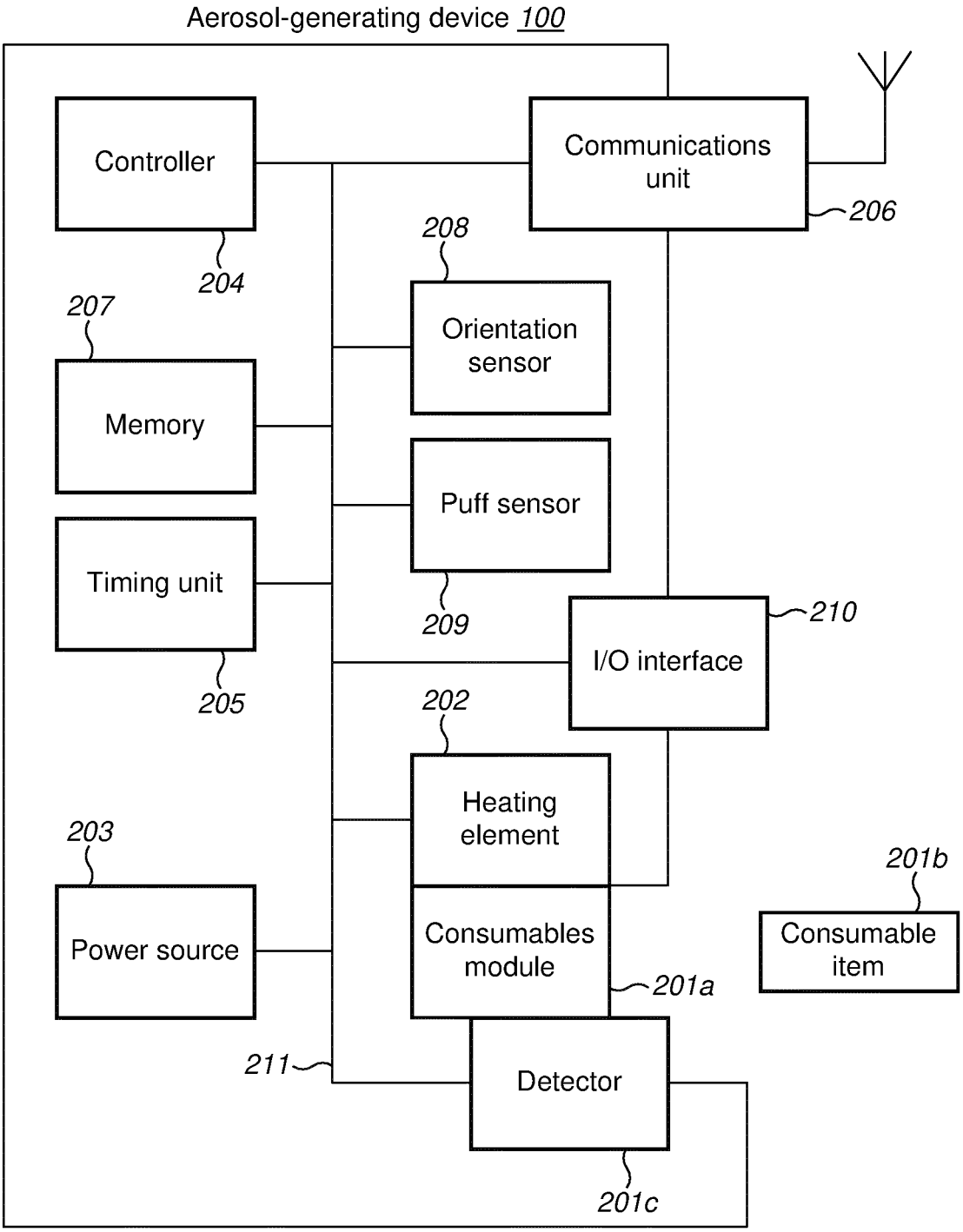
FIG. 2 shows a block diagram of various components of the device of FIG. 1.

FIG. 2 is a block diagram showing various components or modules of the e-cig 100. In one example, the e-cig 100 comprises a consumables module 201*a* and a heating element 202 that vaporizes a consumable item 201*b* received by the consumables module 201*a* to release aerosol containing the flavour and/or stimulant for the user to inhale. In the present example, the consumable item 201*b* is a substance containing nicotine. Presence of the consumable item 201*b* in the consumables module 201*a* may be detected by a detector 201*c*. The consumable item 201*b* may be in the form of solid or liquid and is heated by the heating element 202 to release the aerosol without combustion. In case the consumable item 201*b* is a liquid store, more than one consumable items can be received at the consumable module 201*a*. The heating element 202 may be powered by a power source 203.

The power source 203 is, for example, a lithium ion battery. The power source 203 supplies an electric power necessary for an action of the e-cig 100. For example, the power source 203 supplies the electric power to all other components or modules included in the e-cig 100.

For the purposes of the present description, it will be understood that the terms vapour and aerosol are interchangeable. In some examples, the heating element is arranged within a capsule or cigarette-like aerosol generating material and connectable to the aerosol generation device, rather than being a component of the aerosol generation device itself.

In one embodiment, a flavouring is present in the consumable item 201*b*. The flavouring may include Ethylvanillin (vanilla), menthol, Isoamyl acetate (banana oil) or similar. In another embodiment, the consumable item 201*b* may include an additional flavour source (not shown) provided on the side of the mouthpiece end 103 beyond the consumables module 201*a* the consumable item 201*b*, and generates a flavour to be inhaled by the user together with the aerosol generated from the consumable item 201*b*. In yet another embodiment, the e-cig 100 comprises more than one consumable item each comprising a flavouring and/or a certain level of active component (nicotine). In this case, each consumable item can be independently heated to generate aerosol.

The e-cig 100 also includes a controller 204 that is configured to control various components in the e-cig. For example, the controller 204 may control a timing unit 205 (comprising a timer), a communications unit 206, a memory 207, an orientation sensor 208, and a puff sensor 209 included in the e-cig 100. The timing unit 205 is configured to provide time information (e.g., time of the day) and generate timestamp for puff data or event data, which is helpful to analyse user's vaping preference. The timing unit 205 is further configured to monitor timing of each puff and breaks in between and provide this information to the controller 204 to monitor and potentially restrict the user's usage of the e-cig 100. For example, the timing unit 205 may determine when to indicate the user on reaching a puff threshold. It is to be noted that the functions of the timing unit 205 can be consolidated into the controller 204.

The communications unit 206 is configured to manage communication with any personal computing device, a server, a tracking device, or other e-cigs in the vicinity of the e-cig 100. The memory 207 is configured to store vaping usage history and information such as user settings and preferences.

The e-cig 100 may also include various sensors such as the orientation sensor 208 and the puff sensor 209. The orientation sensor 208, such as a gyroscope, is configured to determine a positional orientation of the e-cig 100, for example, determining if the e-cig 100 is held face up or face down when in use. When the e-cig 100 is used with front face up (such that the activation button 104 and/or an LED and/or a logo is facing upwards), a first mode of operation is activated in which the user is provided an indication on reaching a puff threshold. This mode is also referred to as the session mode.

When the e-cig is used with front face down (such that the activation button 104 and/or an LED is facing downwards), a second mode of operation is activated in which the user is provided with no indication on reaching the puff threshold. This mode is also referred to as the free mode. In other words, the e-cig 100 is rotated or turned by 180 degrees along its longitudinal axis to switch between the session mode and the free mode. In the session mode, with the LED facing upwards, the user is indicated of the puff threshold by the means of the LED which is easily visible to the user. In the free mode, with the LED facing downwards, the puff threshold is not indicated to the user.

It is to be noted that the e-cig 100 facing up or down may also be defined with respect to any visual pattern, such as a logo or a surface design, to act as a reference for the user. Activation button and LED may not be necessary to provide such reference. In any case, sensors on the device may not be reliant on these physical or visual elements.

The puff sensor 209 is configured to determine the number of puff actions of inhaling the aerosol. The puff sensor 209 can also determine a time period required for one puff action of inhaling the aerosol. The recorded usage data can comprise puff duration (i.e., length of a puff), a puff interval (i.e., the time between consecutive puffs), and a fluid and/or nicotine consumption amount.

The e-cig 100 may also include a consumable recognition sensor (now shown) configured to identify the consumable item 201*b* inserted in the e-cig 100. The recognition sensor may be included in the consumables module 201*a* or the detector 201*c*. The recognition sensor may use NFC, RFID or any other known technique to recognise the strength of the stimulant contained in the consumable item 201*b* from an NFC/RFID tag disposed on the consumable 201*b*.

The e-cig 100 may also include an Input-Output (I/O) or user interface 210 configured to provide indications to the user and to receive inputs from the user. The I/O interface 210 preferably comprises an indication device and an input device. The indication device may comprise a visual light emitting element including one or more Light Emitting Diodes (LEDs), a screen display, or a sound emitter, or other appropriate means to provide indication to users. The visual light-emitting element such as an LED may be disposed at the tip of the non-mouthpiece end 102, or on a side surface of the e-cig 100. Such an LED may exhibit various light-emitting mode to provide to user within indication of a puff state where the aerosol is being inhaled, a non-puff state where the aerosol is not being inhaled, a pre-heating state when the heater is heating up, a ready-to vape state when the heater operates at target temperature to generate aerosol, a depletion state where LED bar shows depletion level of the aerosol source, and any other information related to the operation status of the e-cig. The input device can be one or more user operable buttons or sensible touch panel, responsible to depression, toggling, or touch.

All the elements described above transmit and/or receive command and/or data via communication bus 211.

In one embodiment, the e-cig 100 is also configured to communicate with a personal computing device (now shown) owned by the user. The personal computing device may be a smartphone, tablet, or, a laptop. For the sake of simplicity, the personal computing device is referred to as smartphone hereinafter. Preferably, the e-cig 100 is configured to communicably connect or pair with the smartphone wirelessly using Wi-Fi, Bluetooth, or other wireless communication standards. The smartphone preferably runs a mobile application (commonly referred to as App) that allows the user to interact with the e-cig 100 through a user-friendly interface. The App may be hosted by the manufacturer of the e-cig 100 and compatible with different mobile platforms such as iOS™ and Android™

Figure 3:
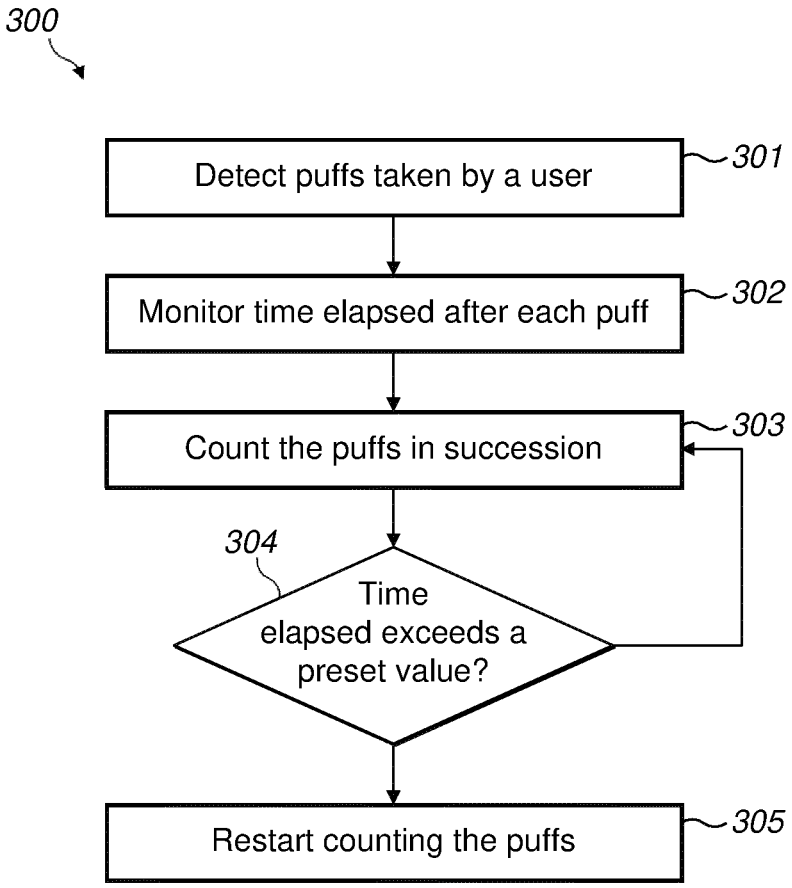
FIG. 3 shows a flow diagram of a method of operating the device of FIG. 1.

FIG. 3 shows a flow diagram for a process 300 of operating the e-cig 100. It is to be noted that steps in the process 300 may not necessarily be performed in the same sequence. Also, not all steps are shown and some of the steps may be optional and can be omitted.

At step 301, puffs taken by a user are detected. In the present example, when the user starts inhaling aerosol from the e-cig 100, the puff sensor 209 detects each puff taken by the user. In each puff the user intakes a certain amount of aerosol but the total amount of aerosol inhaled depends on the duration and number of puffs. The puff sensor 209 preferably communicates with the controller 204 and the timing unit 205 to record the duration and number of puffs taken by the user.

At step 302, a time elapsed after each puff is monitored. In the present example, the controller 204 monitors the usage of the e-cig 100 with the aid of the puff sensor 209 and the timing unit 205. The timing unit 205 starts and stops a timer between two consecutive puffs and monitors periods of breaks taken after each puff. This is explained later in detail with reference to FIGS. 6 and 7. The time elapsed between the end of one puff and the start of the next puff is recorded.

At step 303, the puffs in succession are counted. In the present example, the controller 204 initiates a counter to count the number of puffs inhaled by the user. As the puff sensor 209 detects the start and end of each puff, the counter is successively incremented by one to record the number of puffs taken by the user in one puff session. Any breaks taken by the user between two consecutive puffs is monitored by the timing unit 205 and controller 204 as explained above and the duration of the break determines the counting of puffs. The count of puffs is monitored to warn the user of sustained continuous vaping in the session mode of operation and is recorded in general to analyse the user's vaping pattern over time.

In one embodiment, the user can set up the number of puffs in a session in the session mode based on the user preferences. For example, none, 5, 10, 15, or 20 puffs in one session and user is notified when the set number of puffs in a session are reached. When "none" is selected, no minimum number of puffs are set for a session. Moreover, when the user in the middle of a session and a new parameter or criteria is set, the number of puffs and vaped amount is reset to zero.

At step 304, it is determined if the time elapsed exceeds a preset value. In the present example, the timing unit 205 monitors the period of break taken by the user between two puffs and compares that with a preset value (e.g. 7 minutes). When the break period exceeds that preset value, the process proceeds to step 305, else it goes back to step 303 where the controller 204 continues to count the next puff after the break in succession.

At step 305, the puff counting is restarted. In the present example, when the period of break exceeds the preset value, the controller 205 ends the current puff session and resets the counter. Accordingly, the puffs taken by the user after the long break are counted in a new session. This is explained further below with reference to FIG. 6.

When the e-cig 100 is determined to be in the face up orientation, the session mode is activated and an indication is provided to the user. In the present example, upon determining that the count of number of puffs has reached a puff threshold, the controller 204 activates one or more indicators on the I/O interface 210. For instance, on reaching the 15th puff, an LED on the I/O interface 210 is lit up with soft glow as well as the e-cig 100 is vibrated to provide both visual and haptic indication to the user to remind him or her of sustained continuous vaping. If the user continues to vape after this, a further indication may be provided to the user after another threshold, say after 30 puffs, is reached.

On the other hand, when the e-cig 100 is determined to be in the face down orientation, the free mode is activated and no such indication is provided to the user. In the present example, upon determined that the e-cig 100 is used while facing down, the controller 204 activates the free mode. While in the free mode, the controller 204 continues to monitor the number of counts and a change in the positional orientation of the e-cig 100, but no activate control is done. Therefore, no indication is provided to the user while operating in the free mode, as shown by step 308. However, if during a predefined time period (e.g. during one day), the session mode is activated even once, the e-cig 100 enters a safety mode to provide an indication to the user when a safe threshold is reached in that predefined time period, irrespective of the current active mode of operation. For example, if the user is currently vaping in the free mode and has reached 50 puffs in that day and had at least once vaped with active session mode during that day, the controller 204 provides an indication to the user through the I/O interface 210 on reaching the 50th puff.

In one embodiment, the safe threshold may be based on the strength of the consumable item 201*b* as identified by the recognition sensor. For example, if the nicotine strength of the consumable item 201*b* is 12 mg/ml, then the safe threshold may be automatically set to 50 puffs per day and if the strength is 18 mg/ml, then the safe threshold is set to 40 puffs per day. In another embodiment, the safe threshold may be set based on a user input.

Figure 4:
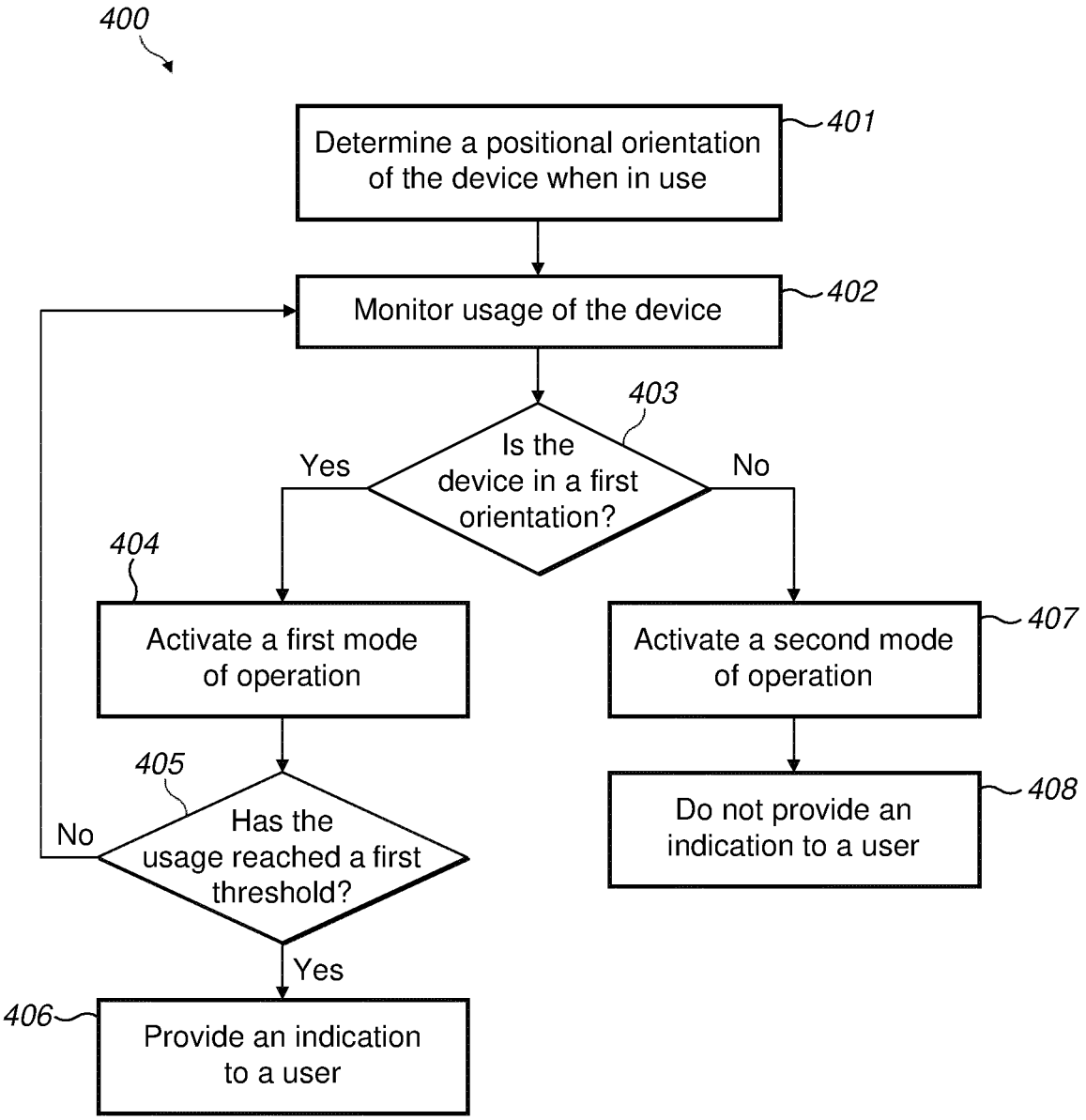
FIG. 4 shows a flow diagram of another method of operating the device of FIG. 1.

FIG. 4 shows a flow diagram for a process 400 of operating the e-cig 100. It is to be noted that steps in the process 400 may not necessarily be performed in the same sequence. Also, not all steps are shown and some of the steps may be optional and can be omitted.

At step 401, a positional orientation of the device is determined when in use. In the present example, when the user starts to use the e-cig 100, the orientation sensor 208 in the e-cig 100 determines if the e-cig 100 is held in a position facing up or facing down. Optionally, the orientation sensor 208 may be activated when the user pushes the activation switch 104. In addition, there may be a motion sensor which detects a movement of the e-cig 100 in addition to the activation of the activation switch 104. Signals from the orientation sensor 208, the activation switch 104, and the motion sensor may all be processed by the controller 204 to determine if one of the two modes of operation is to be activated.

At step 402, usage of the device is monitored. In the present example, when it is determined that the device is in use, irrespective of the orientation, the controller 204 starts monitoring the usage of the e-cig 100 with the aid of the puff sensor 209 and the timing unit 205. The puff sensor 209 detects each puff inhaled by the user and the timing unit 205 time stamps each puff as well as monitors the start and end of each puff. In the session mode, the timing unit 205 starts and stops a timer between two consecutive puffs and monitors a break in a puff session. This is explained later in detail with reference to FIGS. 6 and 7. Nonetheless, in both the session mode and the free mode, the number of puffs inhaled by the user is counted and recorded to analyse the user's vaping pattern over time.

At step 403, it is determined if the device is in a first orientation. In the present example, if the controller 204 determines from the signal received from the orientation session 208 that the e-cig 100 is being held facing up, the process moves to step 404 or else it moves to step 407.

At step 404, a first mode of operation is activated. In the present example, upon determining that the e-cig 100 is held in a position facing up, the controller 204 activates the session mode of operation. In the session mode, the timing unit 205 actively monitors the timing and the count of each puff and communicates with the controller 204 to take necessary action as needed. In one embodiment, the user can set up the number of puffs in a session in the session mode based on the user preferences. For example, none, 5, 10, 15, or 20 puffs in one session and user is notified when the set number of puffs in a session are reached. When "none" is selected, no minimum number of puffs are set for a session. Moreover, when the user in the middle of a session and a new parameter or criteria is set, the number of puffs and vaped amount is reset to zero.

At step 405, it is determined if the usage has reached a first threshold. In the present example, in the session mode, the timing unit continuously monitors the number of puffs taken by the user and compares the count with a predetermined threshold value (also referred to as the puff threshold). When the count reaches the puff threshold, the timing unit 205 informs the controller 204 and the process moves to step 406, else it goes back to step 402 where the controller 204 continues to monitor the usage of the e-cig 100.

At step 406, an indication is provided to the user. In the present example, upon determining that the count of number of puffs has reached the puff threshold, the controller 204 activates one or more indicators on the I/O interface 210. For instance, after reaching the 15th puff (e.g., 1 second after finishing the inhale), an upward facing LED on the I/O interface 210 is lit up with soft glow as well as the e-cig 100 is vibrated (such as two short vibrations) to provide both visual and haptic indication to the user to remind him or her of sustained continuous vaping. In addition, the user may also receive a notification on the app provided on the linked smartphone. If the user continues to vape after this, further indications may be provided to the user after further threshold or Nth puff, say after 30th puff, 45th puff, etc. is reached.

On the other hand, at step 407, a second mode of operation is activated. In the present example, upon determined that the e-cig 100 is used while facing down, the controller 204 activates the free mode. While in the free mode, the controller 204 continues to monitor the number of counts and a change in the positional orientation of the e-cig 100, but no activate control is done. Therefore, no indication is provided to the user while operating in the free mode, as shown by step 408. However, if during a predefined time period (e.g. during one day), the session mode is activated even once, the e-cig 100 enters a safety mode to provide an indication to the user when a safe threshold is reached in that predefined time period, irrespective of the current active mode of operation. For example, if the user is currently vaping in the free mode and has reached 50 puffs in that day and had at least once vaped with active session mode during that day, the controller 204 provides an indication to the user through the I/O interface 210 on reaching the 50th puff.

In one embodiment, the safe threshold may be based on the strength of the consumable item 201*b* as identified by the recognition sensor. For example, if the nicotine strength of the consumable item 201*b* is 12 mg/ml, then the safe threshold may be automatically set to 50 puffs per day and if the strength is 18 mg/ml, then the safe threshold is set to 40 puffs per day. In another embodiment, the safe threshold may be set based on a user input.

Figure 5:
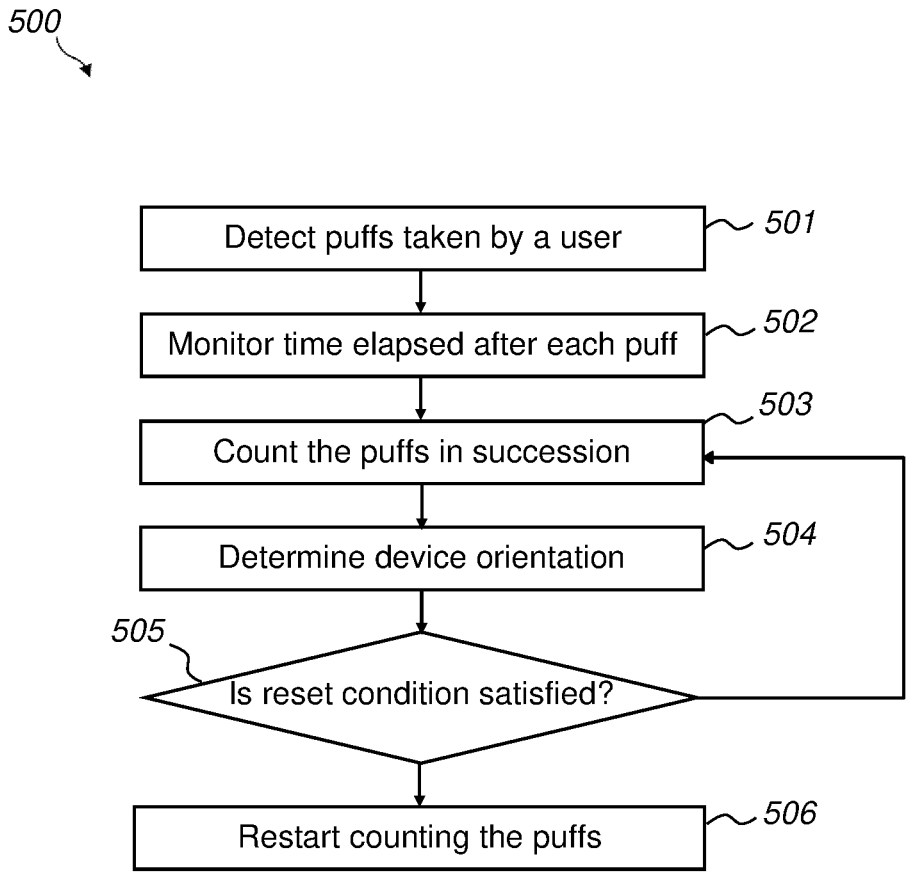
FIG. 5 shows a flow diagram of yet another method of operating the device of FIG. 1.

FIG. 5 shows a flow diagram for a process 500 of operating the e-cig 100. It is to be noted that steps in the process 500 may not necessarily be performed in the same sequence. Also, not all steps are shown and some of the steps may be optional and can be omitted.

At step 501, puffs taken by a user are detected. In the present example, when the user starts inhaling aerosol from the e-cig 100, the puff sensor 209 detects each puff taken by the user. In each puff the user intakes a certain amount of aerosol but the total amount of aerosol inhaled depends on the duration and number of puffs. The puff sensor 209 preferably communicates with the controller 204 and the timing unit 205 to record the duration and number of puffs taken by the user.

At step 502, a time elapsed after each puff is monitored. In the present example, the controller 204 monitors the usage of the e-cig 100 with the aid of the puff sensor 209 and the timing unit 205. The timing unit 205 starts and stops a timer between two consecutive puffs and monitors periods of breaks taken after each puff. This is explained later in detail with reference to FIGS. 6 and 7. The time elapsed between the end of one puff and the start of the next puff is recorded.

At step 503, the puffs in succession are counted. In the present example, the controller 204 initiates a counter to count the number of puffs inhaled by the user. As the puff sensor 209 detects the start and end of each puff, the counter is successively incremented by one to record the number of puffs taken by the user in one puff session. Any breaks taken by the user between two consecutive puffs is monitored by the timing unit 205 and controller 204 as explained above. The count of puffs is monitored to warn the user of sustained continuous vaping in the session mode of operation and is recorded in general to analyse the user's vaping pattern over time.

In one embodiment, the user can set up the number of puffs in a session in the session mode based on the user preferences. For example, none, 5, 10, 15, or 20 puffs in one session and user is notified when the set number of puffs in a session are reached. When "none" is selected, no minimum number of puffs are set for a session. Moreover, when the user in the middle of a session and a new parameter or criteria is set, the number of puffs and vaped amount is reset to zero.

At step 504, an orientation of the device is determined by the orientation sensor 208, and received by the controller 204.

At step 505, it is determined whether a reset condition is satisfied. The controller 204 monitors the data received from the puff sensor 209, the timing unit 205, the orientation sensor 208 and compares with a predetermined reset condition to determine whether the reset condition is satisfied. If the reset condition is not satisfied, then the process goes back to step 503 where the controller 204 continues to count the puffs in succession. If the reset condition is satisfied, then the process continues to step 506.

The reset condition can be based upon a number of combinations of data received by the controller 204 in the previous steps. For example the reset condition may be based on the time elapsed between puffs, where the timing unit 205 monitors the period of break taken by the user between two puffs and compares that with a preset value (e.g. 7 minutes). If the time elapsed exceeds the preset value then the reset condition is satisfied and the process proceeds to step 506, but if the time elapsed is less than the preset value then the reset condition is not satisfied and the process goes back to step 503.

Additionally or alternatively, the reset condition may be based on the orientation of the device. For example, if the controller 204 determines from the orientation sensor 208 that the user changes orientation of the device, then the reset condition is satisfied and the process proceeds to step 506. This may be as a result of a change from the device being in the face up orientation to the face down orientation, or vice versa. The reset condition may further be based on a length of time that the device spends in a particular orientation. For example, the controller 204 monitors both the timing unit 205 and the orientation sensor 208, and the reset condition may only be satisfied once the device changes orientation and remains in that orientation for longer than a predetermined period of time. If instead, the device is returned to its original orientation in less than that predetermined period of time, then the reset condition is not satisfied. The reset condition may be configured this way to prevent accidental changes in device orientation from causing unwanted restarting of the puff counting.

The reset condition may also be based on a number of puffs taken in a predetermined time period. For example if a user takes less than a preset number of puffs (e.g. 3 puffs) in a preset time period (e.g. 15 minutes), then the reset condition is satisfied. In this way, the puff counter resets when it is determined that the user is not engaging in sustained continuous vaping at a time.

The reset condition may further be based on any combination of the time elapsed between puffs, device orientation, time spent in a particular orientation, or number of puffs taken in a preset time period.

At step 506, the puff counting is restarted. In the present example, when the reset condition is satisfied, the controller 205 ends the current puff session and resets the counter. Accordingly, the puffs taken by the user after satisfying the reset condition are counted in a new session.

As discussed previously, an indication may be provided to the user when the count of number of puffs has reached a puff threshold. Whether or not the indication is provided to the user may further depend on the device orientation. To provide the indication to the user, the controller 204 activates one or more indicators on the I/O interface 210. For instance, on reaching the 15th puff, an LED on the I/O interface 210 is lit up with soft glow as well as the e-cig 100 is vibrated to provide both visual and haptic indication to the user to remind him or her of sustained continuous vaping. If the user continues to vape after this, a further indication may be provided to the user after another threshold, say after 30 puffs, is reached.

Figure 6:
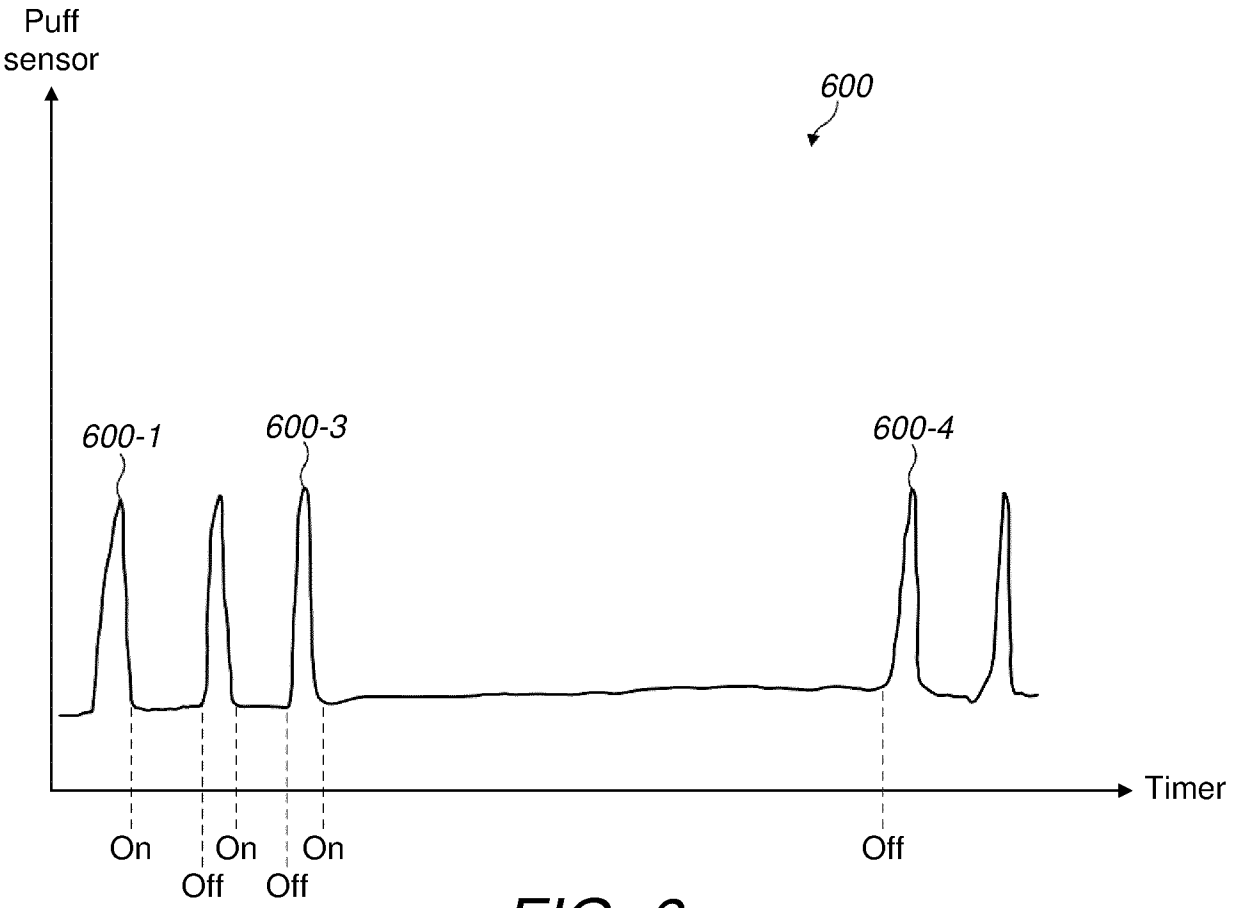
FIGS. 6 and 7 show graphs illustrating a control operation of the device of FIG. 1.

FIG. 6 shows a graph 600 illustrating related responses of the timing unit 205 and the puff sensor 209 in the e-cig 100. The response of the timing unit 205 is plotted on the X-axis against the response of the puff sensor 209 on the Y-axis. The puff sensor 209 detects a first puff 600-1 taken by the user. As soon as the first puff 600-1 is ended, the timing unit 205 starts a timer, i.e. at the trailing edge of the puff wave. The timing unit 205 keeps monitoring the time and the timer is ON until a next puff is detected. As soon as the next puff is detected, i.e. at the leading edge of the next puff wave, the timer is turned OFF. The timer is turned ON again at the trailing edge of this puff wave.

In the session mode, the controller 204 uses this information from the timing unit 205 to monitor breaks taken by the user between the puffs. If the period of break taken between two consecutive puffs, as determined by the timer being turned ON and OFF, is within a preset time period the controller 204 keeps counting the puffs in succession in the same session. When the number of puffs in that session reaches the puff threshold, the controller 204 triggers the I/O interface 210 to provide an indication to the user. On the other hand, when the period of break exceeds the preset time period, e.g. 7 minutes, the controller 204 restarts counting the puffs in a new session. As shown in FIG. 6, after the third puff 600-3 the user takes a long break and then takes the next puff 600-4. If this long break is shorter than 7 minutes, then the timing unit 205 counts this as fourth puff in the same session. However, if this long break is longer than 7 minutes (i.e., the timer in ON state is longer than 7 minutes), the timing unit 205 resets the counter and counts the puff 600-4 is the first puff in a new session. In one embodiment, resetting the counter is only dependent on the state of the timer and irrespective of detection of the next puff. The counter is reset to zero when the timer in "ON" state has reached 7 minutes, and when the next puff is detected, the counter is incremented by one. In this way, no unnecessary indication is provided to the user when he or she is taking long breaks in between and therefore not engaging in sustained continuous vaping at a time.

Figure 7:
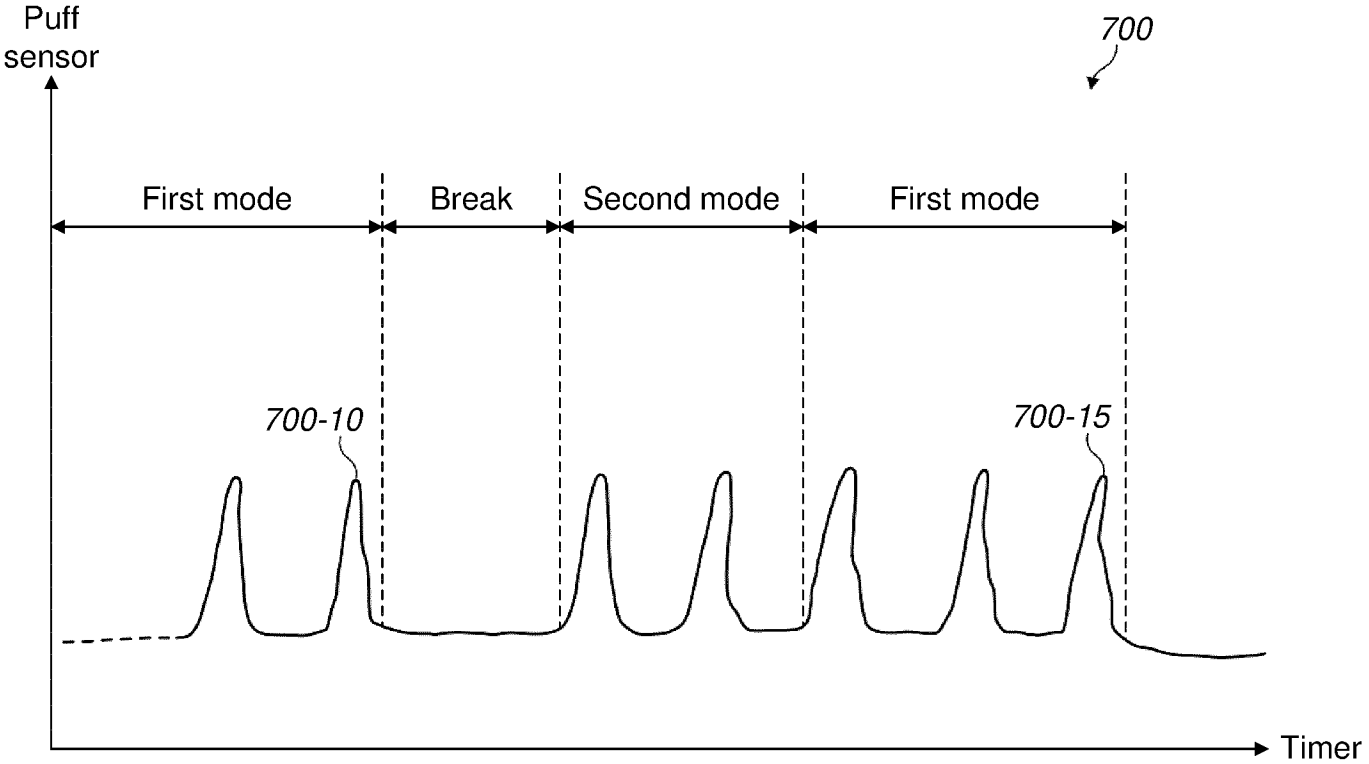

FIG. 7 shows a graph 700 illustrating a puff counting correction methodology employed by the controller 204. The parameters of the graph 700 are same as those of the graph 600. In the present example, the controller 204 monitors a situation in which the user accidently holds the e-cig 100 with face down (hence operate in the free mode) when the user actually intended to continue holding the e-cig 100 with face up (hence operate in the session mode). The controller 204 determines that the e-cig 100 is accidently held in the face down orientation if the user turns it back to the face up orientation within a correction threshold. The controller 204 therefore continues counting the puffs in the session mode and triggers an indication when the puff count exceeds the puff threshold. The correction threshold can be set based on the number of puffs, a set time period, or a combination of the two. For example, if the user takes 3 puffs within 1 minute and then turns the e-cig 100 to face up, then the controller 204 determines that to be accidental and continues counting the puffs in the session mode. However, if the user takes 3 puffs in 5 minutes before turning the e-cig 100 to face up, then the controller 204 determines that to be intentional and does not count those puffs in the session mode.

In a first scenario, consider the user holding the e-cig 100 with face up (activating the first/session mode) and taking ten puffs in one session up to the tenth puff 700-10 as shown in FIG. 7. Then, following a 2 minutes break period, the user accidently takes the next two puffs with the e-cig 100 facing down (activating the second/free mode). The user soon realises the mistake and turns the e-cig 100 facing up (assuming the correction threshold as three puffs within one minute) and takes three further puffs. In this scenario, the controller 204 would understand that the two puffs taken in the face down orientation were accidental, therefore would count those two puffs in the session mode and thus determine the total number of puffs taken to be 15 (puff threshold) and thus provide an indication to the user after the fifteenth puff 700-15.

In a second scenario, with other things being the same as in the first scenario, the user ends up taking five puffs with the e-cig 100 facing down (free mode) before turning the e-cig 100 face up. In this scenario, the controller 204 would not count these five puffs in the session mode as the number of puffs exceeds the correction threshold (as explained above). Therefore, even though the total number of puffs taken by the user is fifteen, no indication is provided to the user.

Figure 8:
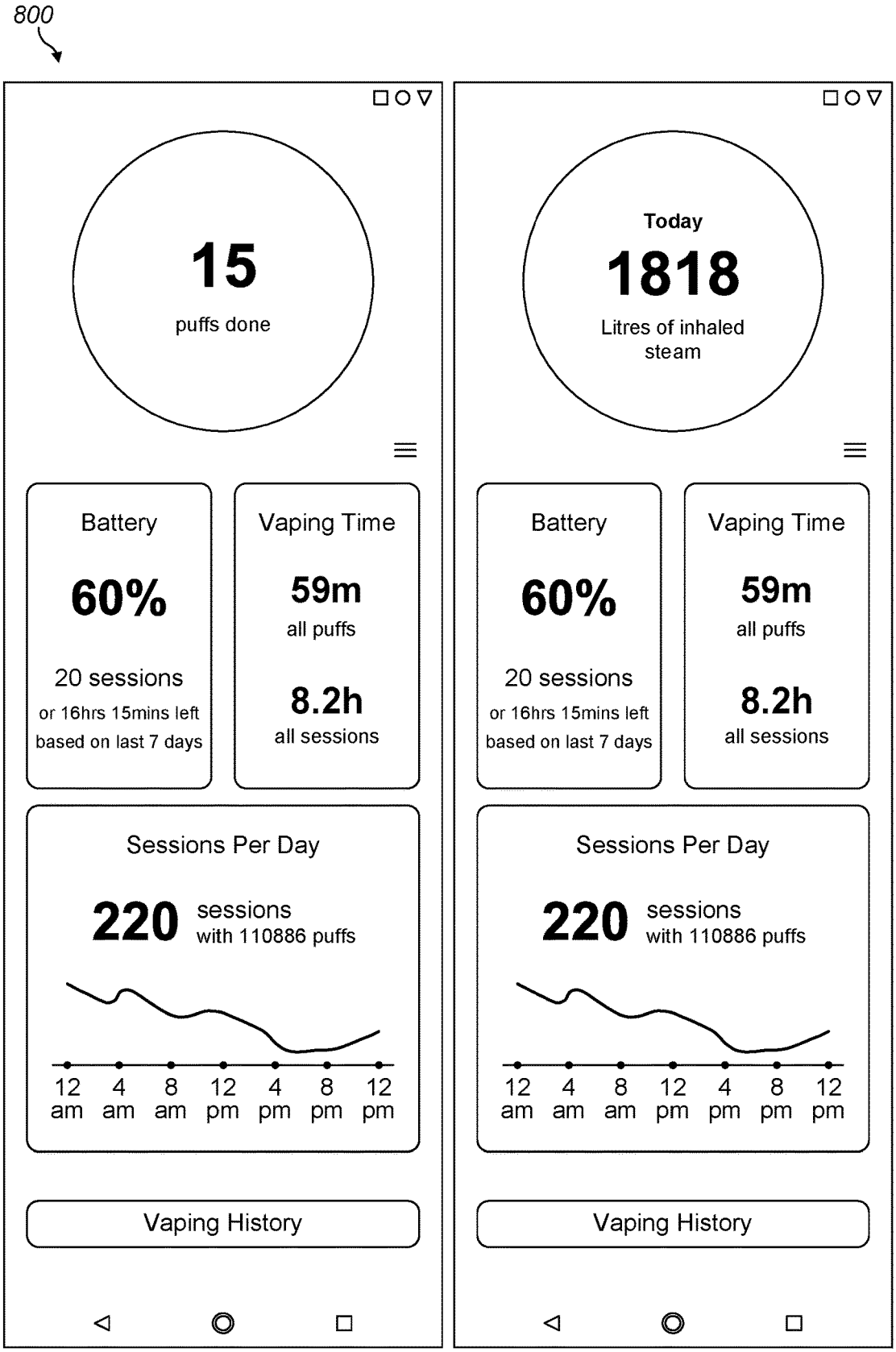
FIG. 8 shows a vaping profile of a user displayed on a personal computing device linked with the aerosol generating device of FIG. 1.

FIG. 8 shows a graphical representation of a vaping profile of the user. In the present example, the app provided on the smartphone linked with the e-cig 100 generates a vaping profile 800 of the user. As can be seen, the vaping profile 800 shows the total number of puffs taken by the user in the current puff session as well as the total quantity of steam or aerosol inhaled by the user in that day. In addition, there is information relating to vaping time and total number of sessions for that day with hourly analysis shown by a line graph. The profile 800 may also show the remaining battery level of the e-cig 100 and indicate the number of remaining sessions or vaping time left with the current battery usage. It is to be noted that the user's vaping history is monitored irrespective of the mode of operation. Therefore, in both the session mode and the free mode, the user may be able to see the overall vaping profile on the app.

It is to be understand that the above described device and the method may be modified according to design choices and manufacturer's preferences. For example, modes of operation may be changed based on other positional orientations of the device. Moreover, the timing control and puff counting sequence may be altered. In addition, various thresholds and preset values may be either hard coded or user configurable.

The controller 204 may also regulate aerosol delivery to increase or decrease the substance in the aerosol and/or add flavours to the aerosol depending on the user's preference. The amount of substance in the aerosol can be modified (increased or decreased) in a number of ways. In one example, the amount of aerosol released from the consumable item 201*b* may be changed, thereby affecting the quantity of substance to be inhaled by the user. In another example, a multi-tank vaping device may be used which includes two or more liquid reservoirs each containing a liquid with different concentration of substance. By switching supply to the reservoir containing a different concentration liquid, it is possible to regulate the substance intake while maintaining the same aerosol amount. In yet another example, substance delivery can be modified by controlling the heating operation (e.g., by controlling the energy supplied to a heater) in heat-not-burn and vapour-based devices, or controlling a pressurized liquid source in vapour-based devices.

The processing steps described herein carried out by the main control unit, or controller, may be stored in a non-transitory computer-readable medium, or storage, associated with the main control unit. A computer-readable medium can include non-volatile media and volatile media. Volatile media can include semiconductor memories and dynamic memories, amongst others. Non-volatile media can include optical disks and magnetic disks, amongst others.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments.

As used herein, the term "non-transitory computer-readable media" is intended to be representative of any tangible computer-based device implemented in any method or technology for short-term and long-term storage of information, such as, computer-readable instructions, data structures, program modules and submodules, or other data in any device. Therefore, the methods described herein may be encoded as executable instructions embodied in a tangible, non-transitory, computer readable medium, including, without limitation, a storage device, and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and non-volatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

As will be appreciated based on the foregoing specification, the above-described embodiments of the disclosure may be implemented using computer programming or engineering techniques including computer software, firmware, hardware or any combination or subset thereof. Any such resulting program, having computer-readable code means, may be embodied or provided within one or more computer-readable media, thereby making a computer program product, i.e., an article of manufacture, according to the discussed embodiments of the disclosure. The article of manufacture containing the computer code may be made and/or used by executing the code directly from one medium, by copying the code from one medium to another medium, or by transmitting the code over a network.

The invention claimed is:

1. An aerosol-generating device comprising:

a body having an inlet and an outlet with an air channel defined between the inlet and the outlet;

an I/O interface configured to provide an indication to a user;

an orientation sensor configured to detect an orientation of the device;

a puff detector configured to detect puffs taken by a user;

a controller configured to:

count the puffs in succession to determine a session mode count number when the device is in a first orientation;

count the puffs in succession when the orientation of the device changes to a second orientation to determine a free mode count number; and correct the session mode count number by adding the free mode count number to the session mode count number when the device returns to the first orientation within a correction threshold.

2. The device of claim 1, further comprising a timing unit configured to determine a time elapsed after each puff.

3. The device of claim 2, wherein the timing unit is configured to start a timer at an end of each puff and stop the timer when the puff detector detects a start of a next puff.

4. The device of claim 2, wherein the timing unit is further configured to associate each puff session with a time stamp to monitor aerosol intake of the user over time.

5. The device of claim 1, further comprising a recognition sensor to identify an aerosol source to monitor an amount of aerosol in each puff taken by the user.

6. The device of claim 1, wherein the correction threshold is set based on a number of puffs in the second orientation, a set time period, or a combination of the two, and the controller is further configured to provide an indication to the user when the session mode count number, or the corrected session mode count number exceeds a puff threshold.

7. A method of operating the aerosol-generating device of claim 1, the method comprising:

detecting puffs taken by a user;

monitoring a time elapsed after each puff;

counting the puffs in succession to determine the session mode count number when the device is in the first orientation;

counting the puffs in succession when the orientation of the device changes to the second orientation to determine the free mode count number; and correcting the session mode count number by adding the free mode count number to the session mode count number when the device returns to the first orientation within a correction threshold.

8. The method of claim 7, further comprising counting the puffs in succession unless a reset condition is satisfied, and determining an orientation of the device, wherein the reset condition is based on the orientation of the device.

9. The method of claim 8, wherein the reset condition is based on a length of time in which the device remains in a particular orientation.

10. The method of claim 7, further comprising counting the puffs in succession unless a reset condition is satisfied, wherein the reset condition is based on a determination of whether the time elapsed is greater than a first preset value.

11. The method of claim 7, further comprising counting the puffs in succession unless a reset condition is satisfied, wherein the reset condition is based on a number of puffs taken in a predetermined period of time.

12. The method of claim 7, further comprising providing a first indication to the user when the number of puffs reaches a first count when the device is determined to be temporarily held in the second orientation for less than a predetermined period of time and is turned to the first orientation within the predetermined period of time.

13. The method of claim 12, further comprising providing a second indication to the user when a total number of puffs at the end of a predetermined period of use reaches a second count when the device is determined to be held in the first orientation at least once during the predetermined period of use.

14. The method of claim 13, wherein the total number of puffs is determined by a time stamp associated with each puff.

15. The method of claim 13, wherein the total number of puffs is determined by maintaining a count of puffs for a period set by the user.

16. The method of claim 13, wherein the second indication is only provided when an amount of aerosol delivered in the total number of puffs exceeds a threshold level.

17. A control circuitry for use in an aerosol-generating device, the control circuitry configured to actuate the method of claim 7.

18. A non-transitory computer-readable storage medium comprising instructions stored thereon which, when executed by a computer, cause the computer to carry out the steps of the method of claim 7.

* * * * *